United States Patent [19]

Borgran

[11] 4,122,824

[45] Oct. 31, 1978

[54] DEVICE FOR EXTRACTING HEAT FROM A FIREPLACE

[76] Inventor: Peter M. Borgran, 2131 E. Second St., Duluth, Minn. 55812

[21] Appl. No.: 852,492

[22] Filed: Nov. 17, 1977

Related U.S. Application Data

[63] Continuation of Ser. No. 703,098, Jul. 6, 1976, abandoned.

[51] Int. Cl.[2] ..... F24B 7/00

[52] U.S. Cl. ..... 126/121; 237/51; 126/139

[58] Field of Search ..... 126/121, 138, 139, 122; 237/51

[56] References Cited

U.S. PATENT DOCUMENTS

| | | | |
|---|---|---|---|
| 394,042 | 12/1888 | Wheeler | 126/121 |
| 419,659 | 1/1890 | Graves | 126/138 |
| 2,362,526 | 11/1944 | Austin | 126/121 |
| 2,787,997 | 4/1957 | Asburn | 126/121 |
| 3,930,490 | 1/1976 | Lassy et al. | 126/121 |

FOREIGN PATENT DOCUMENTS

| | | | |
|---|---|---|---|
| 135,380 | 11/1919 | United Kingdom | 126/121 |
| 745,823 | 3/1956 | United Kingdom | 126/121 |
| 785,699 | 11/1957 | United Kingdom | 126/121 |
| 1,095,644 | 12/1967 | United Kingdom | 126/121 |

*Primary Examiner*—William F. O'Dea
*Assistant Examiner*—Harold Joyce
*Attorney, Agent, or Firm*—Wicks & Nemer

[57] ABSTRACT

A device for extracting heat from a fireplace and directing it into a room including a U-shaped tubular member adapted to fit into the opening of fireplace the length of which is adjustable. The tubular member has an intake opening at one end and an exhaust conduit at the other end together with a fan for causing air to move through the member. The tubular member has a baffle inside thereof whereby air moving through the member is thoroughly warmed prior to its exit out the exhaust conduit.

1 Claim, 6 Drawing Figures

DEVICE FOR EXTRACTING HEAT FROM A FIREPLACE

CROSS REFERENCE

This is a continuation of application Ser. No. 703,098, filed July 6, 1976, now abandoned.

SUMMARY

The invention relates to an improvement in heating devices and more particularly to a device for extracting heat from a going fireplace and directing it into a room. It is an object of the invention to provide a U-shaped tubular member which mounts within and at the opening of a fireplace. The member has an intake opening at one end and an exhaust conduit at the other end together with a fan for causing air to move through the member wherein it is warmed by heat radiating from a fire in the fireplace. It is a further object of the invention to provide a baffle within the tubular member to slow up the movement of air through the same whereby the air is more thoroughly warmed.

It is an additional object of the invention to provide means for adjusting the length of the tubular member so that it will fit fireplaces of different dimensions.

In the drawings forming part of this application:

Figure 1:
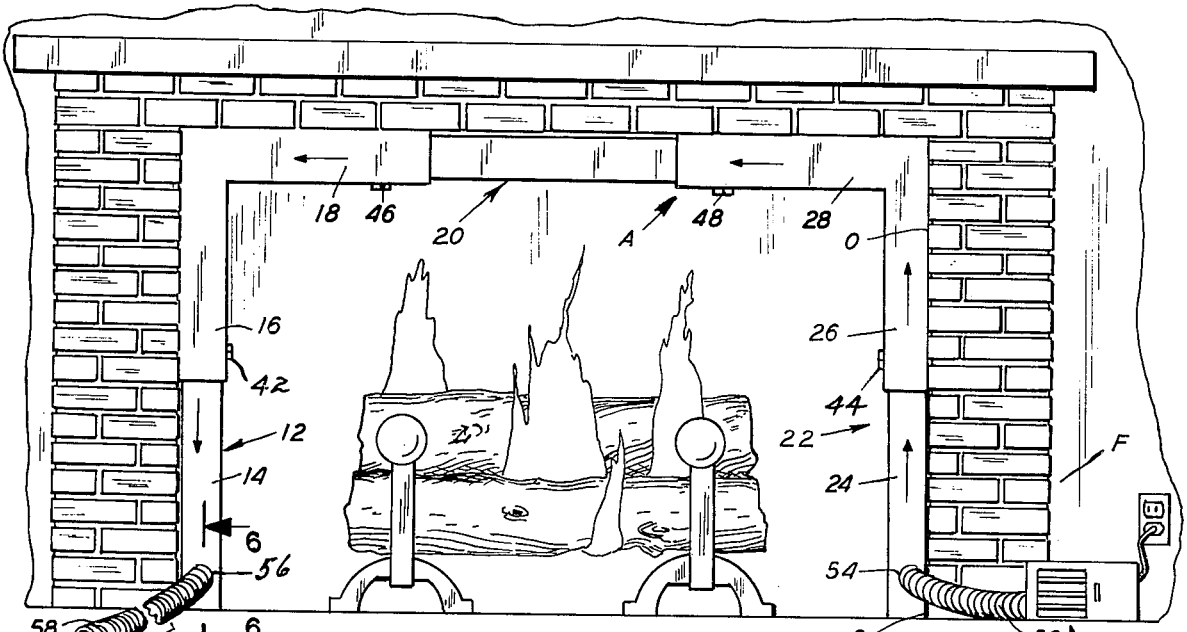
FIG. 1 is a front elevational view of a thermal extractor for a fireplace shown in operative position in a fireplace and embodying the invention.
Figure 2:
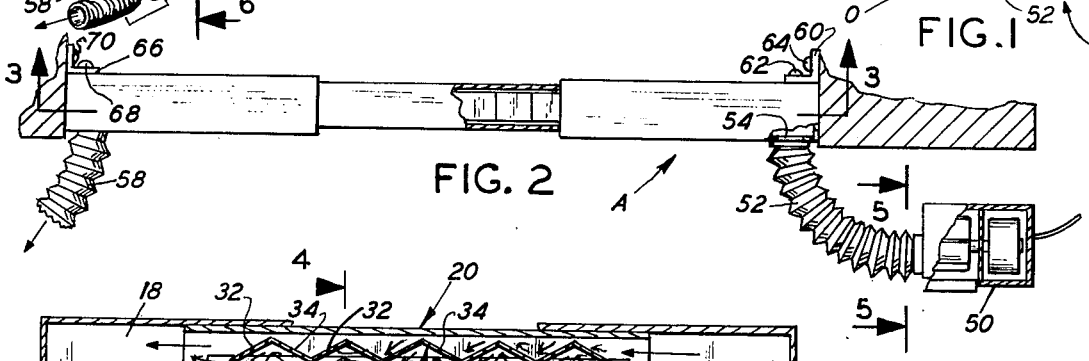
FIG. 2 is a top plan view of the extractor with a portion thereof broken away.
Figure 3:
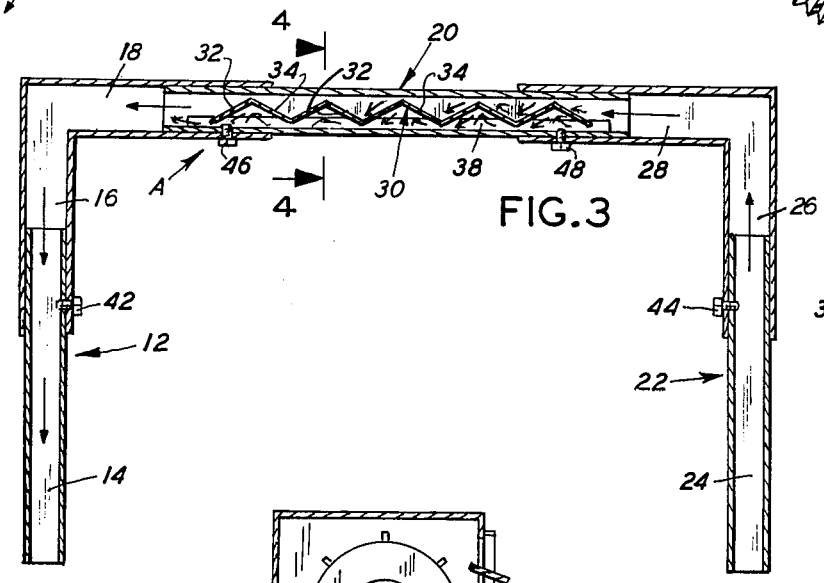
FIG. 3 is a sectional view on the line 3—3 of FIG. 2.
Figure 4:
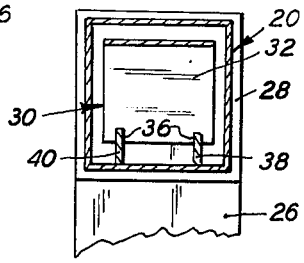
FIG. 4 is a sectional view on the line 4—4 of FIG. 3.
Figure 5:
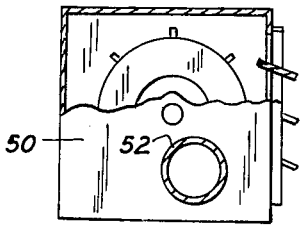
FIG. 5 is a view on the line 5—5 FIG. 2.
Figure 6:
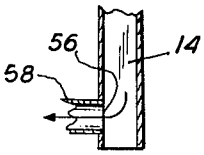
FIG. 6 is a sectional view on the line 6—6 of FIG. 1.

Referring to the drawings in detail, the thermal extractor A for a fireplace such as F includes the first leg member 12 formed of the lower tubular vertical portion 14. The portion 14 slidably fits into the upper tubular vertical portion 16. The upper portion 16 terminates at its upper end in the right angular horizontal tubular portion 18. The numeral 20 designates a central tubular horizontal portion which at one end slidably fits into the tubular portion 18.

Further provided is the second leg member 22 formed of the lower tubular vertical portion 24. The portion 24 slidably fits into the upper tubular vertical portion 26. The upper portion terminates at its upper end in the right angular horizontal tubular portion 28. The tubular portion 28 receives therein one end of the central tubular portion 20. The tubular portions 18, 20, and 28 form a horizontal top cross member connected to and communicating with the tubular first and second leg member which forms a U-shaped device.

The numeral 30 designates a baffle secured within the central tubular portion. The baffle includes the series of plate portions 32 joined by plate portions 34 at oblique angles. The baffle plate portions 32 and 34 are secured to slots 36 formed in the spaced rails 38 and 40 which are secured to the bottom of the tubular member 20.

The baffle retards the flow of air through the extractor A thereby warming the air passing through the device to a greater extent.

The vertical height of the extractor A is adjustable to fit different height openings by sliding the portions 14 and 24 to or from the portions 16 and 26 and then securing the two portions together by means of metal screws 42 and 44.

The lateral dimension of the device is adjustable by slidably moving either of the tubular portions 18 and 28 relative to the central portion 20 and securing the same by means of the metal screws 46 and 48.

Further provided is the conventional blower fan 50 connected to the conduit 52 which in turn is connected to the inlet opening 54 formed in the tubular portion 24. The tubular portion 14 is formed with the outlet opening 56 to which is connected the outlet conduit 58 used to direct heated air into the room where desired. The device is secured within the fireplace opening O by means of the angle 60 secured to the inside surface of the tubular portion 26 and the side of the opening O by means of the screws 62 and 64. The device is further secured by means of the angle 66 secured to the inside surface of the tubular portions 16 and the side of the opening O by means of the screws 68 and 70.

In use the device A is secured in position in the fireplace and with a fire in the fireplace the device is heated. The fan is then started which forces room air through the device whereby it is heated and caused to exit out the conduit 58.

Having thus described the invention, what is claimed as new and desired to be secured by Letters Patent is:

1. A thermal extractor for a fireplace opening comprising:

(a) an inverted U-shaped tubular member for securing to the front vertical and horizontal edges of the opening of a fireplace to be heated from heat in the fireplace, (b) said tubular member having a rectangular cross section and including a tubular top central portion having an adjustable length substantially equal to the width of the fireplace opening at the top front edge thereof, (c) a tubular leg portion depending from each end of said top central portion having an adjustable length substantially equal to the height of the fireplace opening at the front side edge thereof, said legs and said top central portion lying in substantially the same plane, (d) one of said legs having an inlet tube member at the lower end thereof, (e) the other of said legs having an outlet tube member at the lower end thereof, (f) said top central portion having a baffle member internally thereof, (g) a fan carried by said inlet tube, (h) said top central portion having a portion slidable within the remaining portion, (i) each of said legs having a portion slidable within the remaining portion, (j) means for securing said portions of said top central portion against displacement, (k) means for securing said portions of each of said leg portions against displacement, (l) a fan carried by said inlet tube member adapted to circulate heated air through said top central portion and said leg portions and out through said outlet tube member.

* * * * *